US007260965B2

(12) United States Patent
Hung

(10) Patent No.: US 7,260,965 B2
(45) Date of Patent: Aug. 28, 2007

(54) LOCKING DEVICE

(75) Inventor: Chun I. Hung, Taipei Hsien (CN)

(73) Assignee: Andamiro Co., Ltd., Seoul (KR)

( * ) Notice: Subject to any disclaimer, the term of this patent is extended or adjusted under 35 U.S.C. 154(b) by 0 days.

(21) Appl. No.: 11/178,817

(22) Filed: Jul. 11, 2005

(65) Prior Publication Data

US 2006/0016232 A1 Jan. 26, 2006

(30) Foreign Application Priority Data

Jul. 21, 2004 (TW) ..... 93211540 U

(51) Int. Cl.
*E05B 35/12* (2006.01)

(52) U.S. Cl. ..... 70/339; 70/358; 70/389; 70/395; 70/454; 70/491; 70/492; 70/DIG. 63

(58) Field of Classification Search ..... 70/337–343, 70/453, 454, 491, 389, DIG. 63, 403, 404, 70/400, 375, 492, 395, DIG. 37, 397, 398, 70/401, 409, 358, 408
See application file for complete search history.

(56) References Cited

U.S. PATENT DOCUMENTS 1,382,826 A * 6/1921 Dove ..... 70/358
1,644,323 A * 10/1927 Borsody ..... 70/134
1,689,875 A * 10/1928 Jacobi ..... 70/216
1,990,933 A * 2/1935 Falk ..... 70/492
2,036,764 A * 4/1936 Lowe ..... 70/369
2,220,786 A * 11/1940 Grainger ..... 70/262
2,298,697 A * 10/1942 Hofmann ..... 70/395
2,298,698 A * 10/1942 Hofmann ..... 70/358
2,544,305 A * 3/1951 Finke et al. ..... 70/265
2,783,636 A * 3/1957 Scott ..... 70/347
3,008,322 A * 11/1961 Stackhouse ..... 70/395
3,336,774 A * 8/1967 Gray et al. ..... 70/367
3,656,328 A * 4/1972 Hughes ..... 70/276
3,729,964 A * 5/1973 Hsu ..... 70/338
3,863,476 A * 2/1975 Patriquin ..... 70/419
3,941,954 A * 3/1976 Wintringham ..... 200/43.08
4,100,777 A * 7/1978 Fredon ..... 70/491
4,120,184 A 10/1978 Gerlach ..... 70/389

(Continued)

FOREIGN PATENT DOCUMENTS

KR 0181643 12/1998

(Continued)

OTHER PUBLICATIONS

International Search Report, Application No. PCT/KR2005/002197, mailed Sep. 12, 2005.

*Primary Examiner*—Lloyd A. Gall
(74) *Attorney, Agent, or Firm*—Renner, Otto, Boisselle & Sklar, LLP

(57) ABSTRACT

A locking device, which mounts a user key (the first key) and a manager key (the second key) separatedly, places a first lock and a second lock unitedly in an outer cylinder. The first lock is opened or rotated by the first key. After the first lock is open, the first key cannot be pulled out of the locking device. If the second lock is open by the second key, the first key can be pulled out together with the second key.

12 Claims, 7 Drawing Sheets

U.S. PATENT DOCUMENTS 4,472,952 A * 9/1984 Hollowell, Jr. ..... 70/61
5,010,754 A * 4/1991 De Angelo et al. ..... 70/389
5,060,491 A 10/1991 Smith ..... 70/63
5,265,454 A * 11/1993 Crocco et al. ..... 70/380
5,440,909 A 8/1995 Ely et al. ..... 70/395
5,475,997 A * 12/1995 Chung ..... 70/375
6,058,750 A * 5/2000 Li ..... 70/358
6,536,244 B1 * 3/2003 Chang ..... 70/58
6,584,819 B1 * 7/2003 Hung ..... 70/491
6,968,716 B1 * 11/2005 Ling ..... 70/14

FOREIGN PATENT DOCUMENTS

KR 20-0272537 4/2002

* cited by examiner

LOCKING DEVICE

TECHNICAL FIELD

The present invention relates to a locking device. More specifically, the present invention relates to a locking device in which a lock for a user key and a lock for a manager key are mutually and organically united.

BACKGROUND ART

As publicly known, the conventional lock or the locking device can be open by only one key. Also, it is designed in such a manner that after the lock is open or locked by the key, the key can be pulled out from the lock.

Thus, in the case of the locking device used publicly, for example, the locking device used for a locker in a subway station or a public bath, the manager had to manage the key one by one in order to prevent the key from being taken away by the user. Currently, in order to resolve such problem, at the time of using the locker, the locking device is designed in such a manner that the user cannot pull out the key while the locker is open.

However, both cases have problems in that the locker cannot be used if the user takes away the key at the locking state, and the lock has to be renewed or repaired. In particular, in the case that the user cannot pull out the key when the locker is open, it was difficult to manage the key since the key should always be inserted into the lock of the locker.

Meanwhile, the above locking device is used when the department store, the big supermarket or an amusement hall provide a predetermined key with a winner who wins a free gift so the winner opens the door of the gift box with the predetermined key to take the free gift. However, if the winner can pull out the key from the gift box after opening the lock of the box, the key could be missing. However, if the key cannot be pulled out, there still exists a problem that the manager needs to manage the key one by one for the next use.

DETAILED DESCRIPTION OF THE INVENTION

In order to resolve aforementioned problems, a main object of the present invention is to provide a locking device in which a user key and a manager key are separatedly used and after the lock is open by the user key, the user key cannot be pulled out from the locking device without the manager key.

Another object of the present invention is to provide a locking device mounting two locks in an outer cylinder having different opening ways, in which a first lock is open by rotating a first key. If the first key is rotated, clamping members of a second lock are located in a second locking recess in the outer cylinder. At this time, the first key is not pulled out from the first lock due to a limitation ring, but by inserting the second key which rotates the first key to the initial location, the two keys are simultaneously pulled out.

The other object of the present invention is to provide a locking device mounting two locks in the outer cylinder having different opening ways, in which the first key is cylindrical and has a key inserting recess in its center. The center of the first cylindrical key which opens the first cylindrical lock has a central key hole. The second key is inserted to the second lock through the central key hole of the first cylindrical key and the key inserting recess of the first lock, and if the second key is rotated to rotate and open the second lock, the first lock is rotated to the initial location, so that the two keys are simultaneously pulled out.

The other object of the present invention is to provide a locking device mounting two locks in the outer cylinder having different opening ways, in which the first and second locks are integrally formed by combining an engaging pole with an engaging recess, and if the first lock is rotated and open, the second lock is rotated together so that a rotating plate in one end of the second lock is rotated. Therefore, the two locks can operate separatedly.

The other object of the present invention is to provide a locking device mounting two locks having different opening ways in the outer cylinder, in which the first and the second locks are integrally formed by combining the engaging pole and the engaging recess. The second lock is formed in an inner cylinder. The locations of the clamping members in the recess of the inner cylinder are moved from the first locking recess to the second locking recess while the first lock is rotated and open. At this time, the first key is not pulled out from the first lock due to the limitation ring, but by inserting the second key which rotates the first key to the initial location, the two keys are simultaneously pulled out.

In order to achieve the above object, the locking device according to the present invention comprises:

a first key capable of converting a first lock into an opening state or a locking state;

a second key capable of converting a second lock into an opening state or a locking state;

a first lock including a first key inserting recess, and which does not discharge the first key from the first inserting recess in case that the first key is inserted into the first inserting recess to convert the first lock from the locking state into the opening state; and a second lock including a second key inserting recess, and converting the first lock from the opening state into the locking state in case that the second key is inserted into the second inserting recess to convert the second lock from the locking state into the opening state.

Preferably, the first lock and the second lock are cooperated by the combination of the engaging pole with the engaging recess, and the first key is cylindrical and has a central key hole to which the second key penetrates its center.

PREFERRED EMBODIMENT

Hereinafter, the preferred embodiment of the present invention is explained by referring to the attached drawings. Identical reference numbers are used for the identical or similar constitutional elements.

Figure 1:
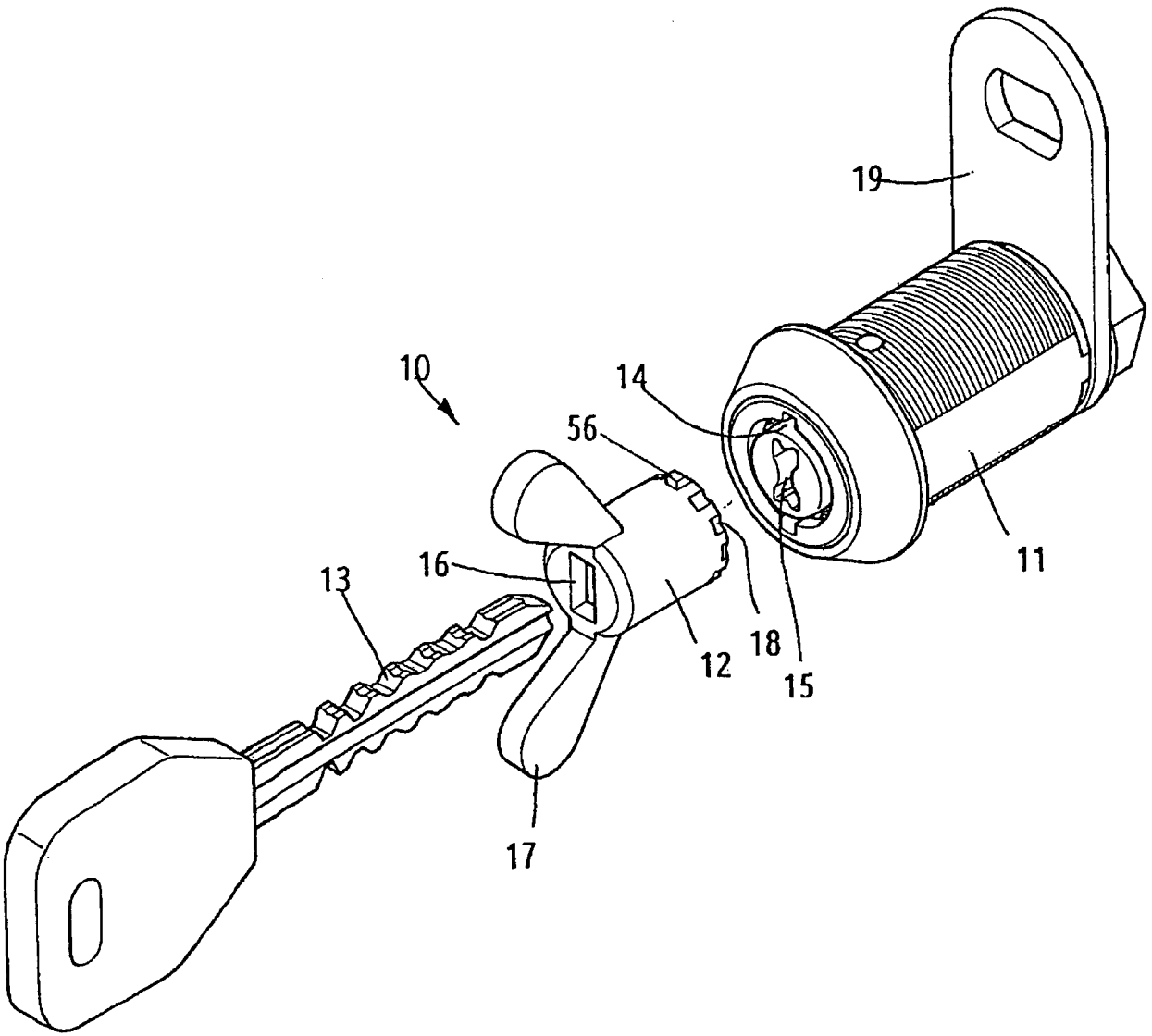
FIG. 1 is a top perspective view showing a locking device according to the present invention.
Figure 2:
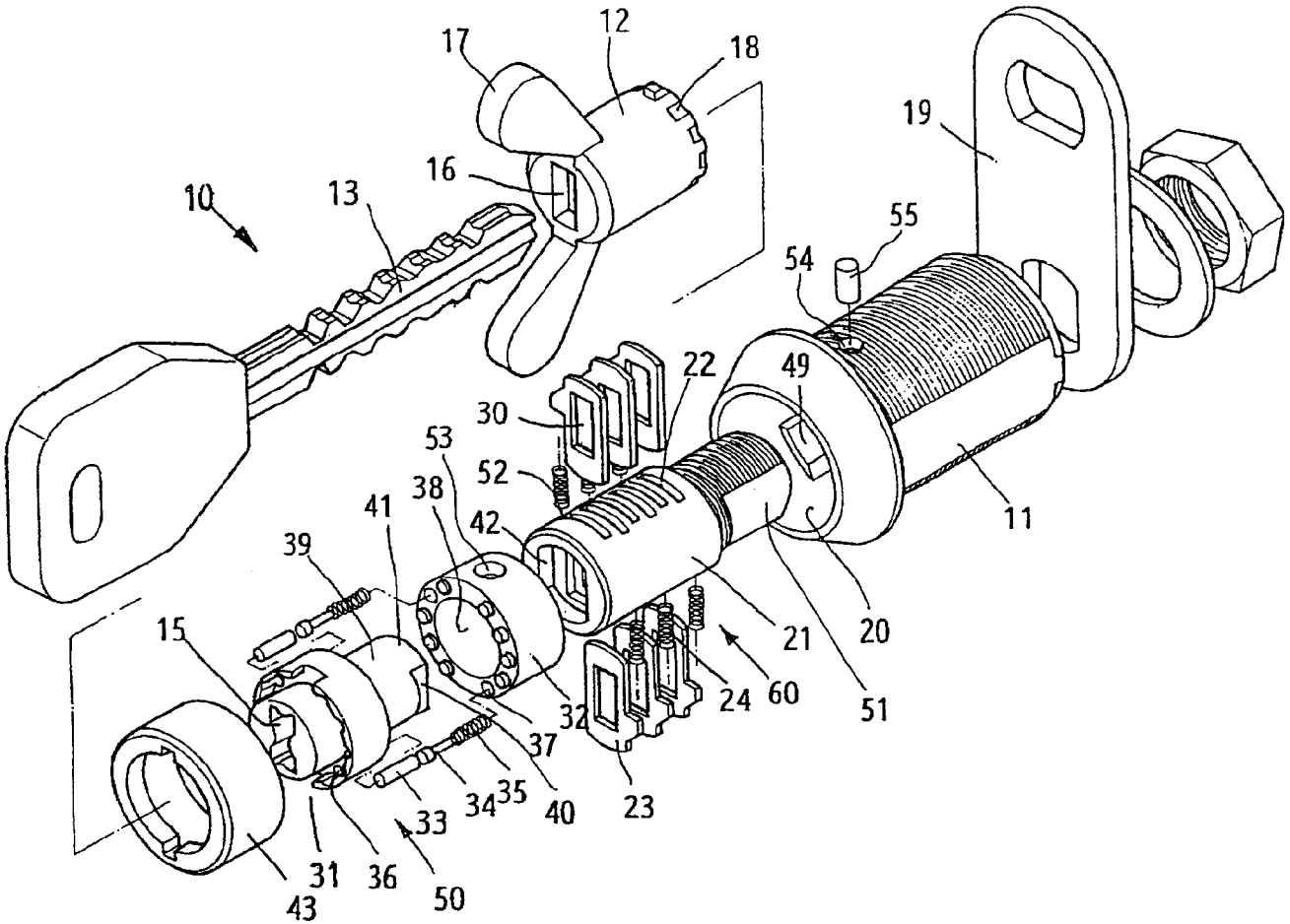
FIG. 2 is an exploded perspective view showing a locking device according to the present invention.
Figure 3:
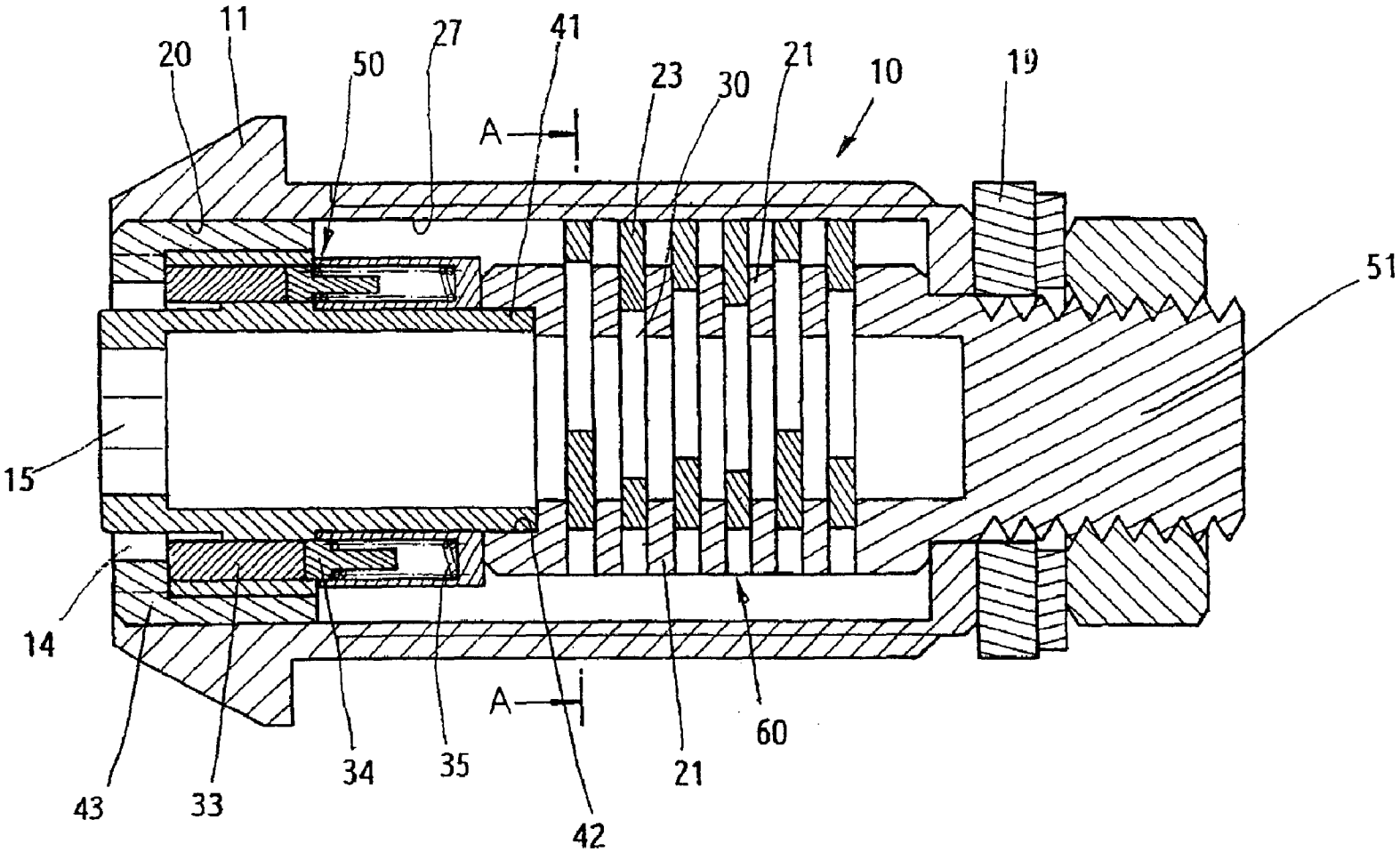
FIG. 3 is a cross-sectional view showing a locking device according to the present invention.

Referring to FIGS. 1-3, an outer cylinder (11) is arranged in a fixed object such as a door of a locker. A first lock (50) and a second lock (60), which have different shapes, are placed inside of the outer cylinder (11). If a user rotates the first cylindrical key (12) by 90° to rotate the first lock (50) located outside, the clamping members (23) of the second lock (60) move from the first locking recess (27) to the second locking recess (28) along a guiding surface (29) inside of the outer cylinder (11). Then, the first key (12) is clamped with the first lock (50) due to the limitation ring (43) and thus it cannot be discharged. Thereafter, the second key (13) is inserted through a central key hole (16) of the first key (12), the key inserting recess (15) of the first lock (50) and the center of the second lock (60) one after another. At the time of opening the second lock (60) by rotating the second key (13), the clamping members (23) of the second lock (60) are released from the second locking recess (28) to convert the second lock (60) into an opening state. Therefore, the first and second keys (12, 13) are simultaneously pulled out and the locking device (10) returns to the initial state.

Referring to FIGS. 1-4 again, the outer cylinder (11) mounting the first and the second locks (50, 60) has a cylindrical hole (20) at the end of its outer center portion. After completing the assembling and engaging processes of the locking device (10), a limitation ring (43) is placed in the cylindrical hole (20) at the outer end of the assembled device. The limitation ring (43) is combined with the outer cylinder (11) to form a key inserting recess (14). After the first key (12) is inserted into the key inserting recess (14) and rotated to open the first lock (50), the reference projection (56) formed on one end of the first key (12) is clamped with the limitation ring (43) to prevent the first lock (50) from being discharged.

Figure 4:
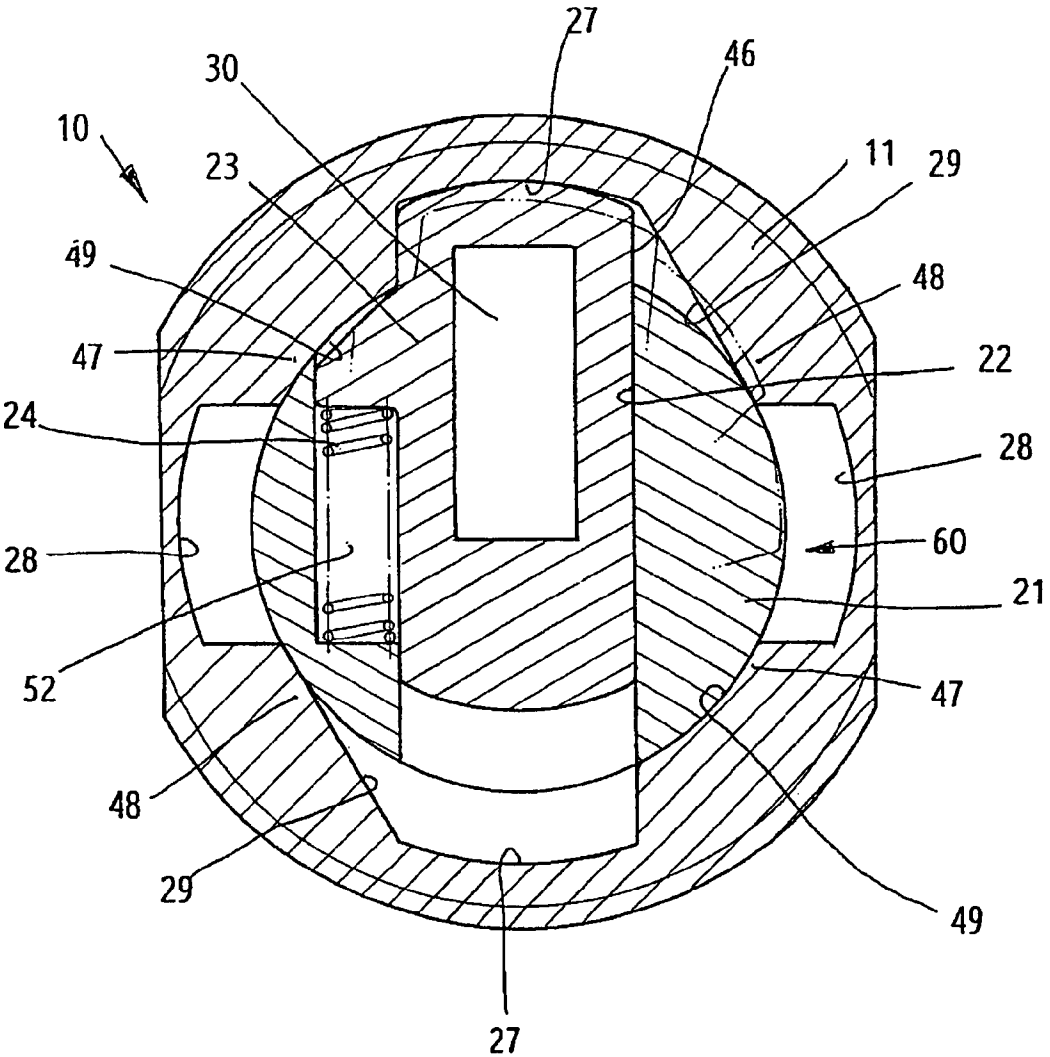
FIG. 4 is a cross-sectional view of a locking device taken along the line A-A in FIG. 3 according to the present invention.
Figure 5:
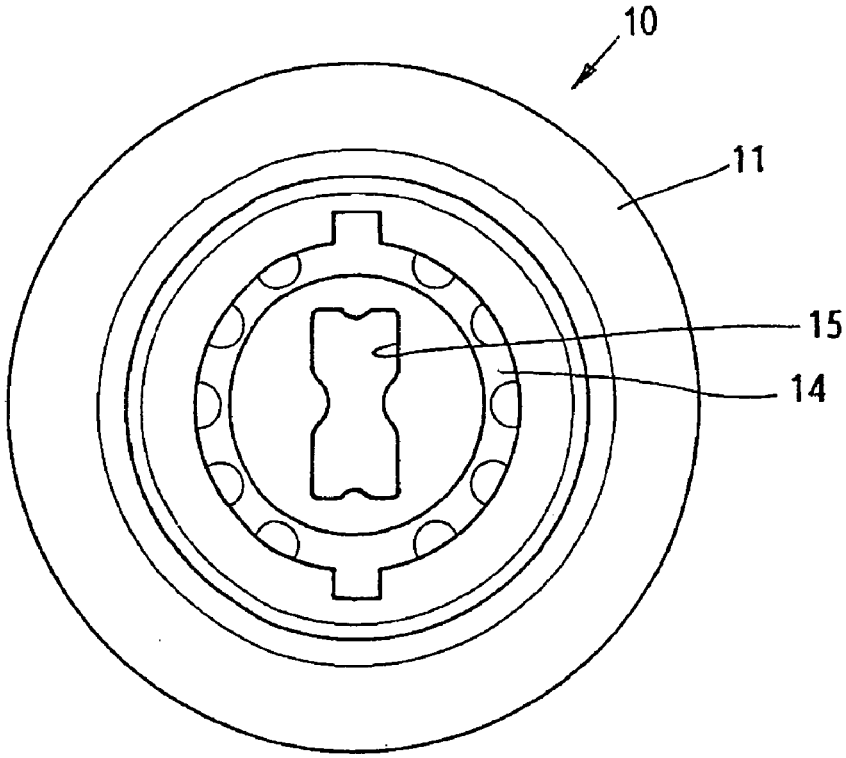
FIG. 5 is a floor plan view of a locking device according to the present invention showing a locking state of a lock.
Figure 6:
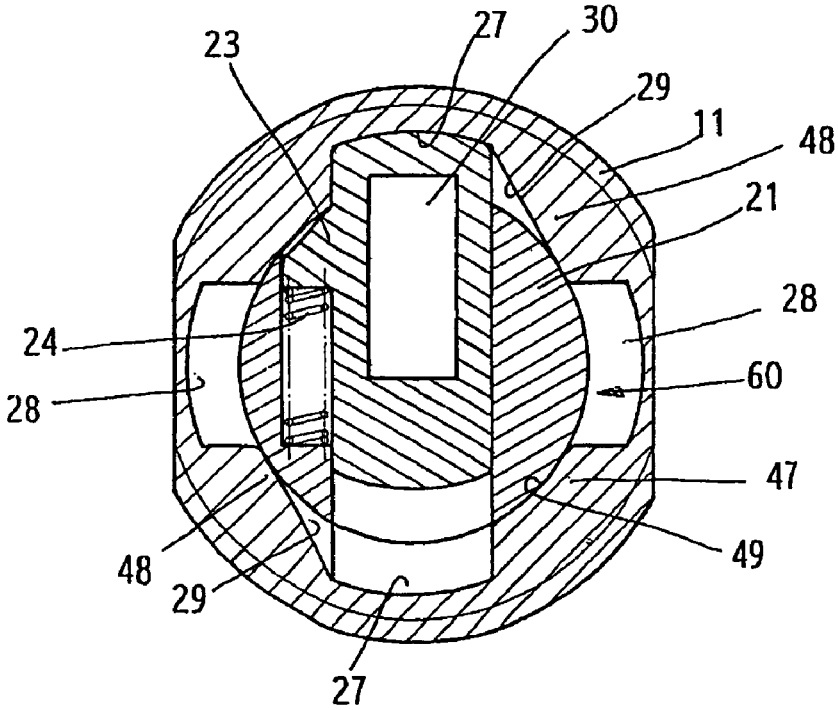
FIG. 6 is a cross-sectional view of a locking device according to the present invention showing a locking state of a second lock in case that a first lock is locked.

Referring to FIGS. 3 and 4, a supporting part (47) and a guiding part (48) are symmetrically extended to each other in the inner peripheral surface of the cylindrical hole (20). A first locking recess (27) and a second locking recess (28) are respectively formed between the adjacent supporting part (47) and the guiding part (48). Also, supporting surfaces (49) contacting the outer peripheral surface of the inner cylinder (21) of the second lock (60) are formed in the interior surface of the supporting part (47), which is symmetrically formed in the outer cylinder (11). The supporting surfaces (49), which are formed symmetrically to each other, are contacted to the outer peripheral surface of the second lock (60) when the second lock (60) has completed assembling. Also, at the time of rotating the second lock (60), the supporting surfaces (49) support the second lock (60) to maintain the location of the second lock (60).

The guiding part (48) formed on the side surface of the first locking recess (27) is extended a slope from one end of the first locking recess (27) to the second locking recess (28). The other end of the guiding part (48) forms a step part by an angle formed by the second locking recess (28), and the end is separated at a predetermined distance from the bottom of the second locking recess (28). Thus, if the second lock (60) is inserted into the first locking recess (27) while the clamping members (23) are placed in the second lock (60), a plurality of clamping members (23) in the inner cylinder are pushed away and arranged in the interior space of the first locking recess (27).

At the time of rotating the inner cylinder (21), a plurality of clamping members (23) simultaneously move and rotate, and the clamping members (23) move along the guiding surface (29) of the guiding part (48). If the inner cylinder (21) is rotated by 90°, the plurality of clamping members (23) are introduced to the interior space of the second locking recess (28) due to the elasticity of a spring (24). Then, the clamping members (23) are engaged with both of the second locking recesses (28) to limit the rotation of the inner cylinder (21). Accordingly, the first lock (50) placed outside cannot rotate any more.

The first and the second locks (50, 60) are placed in the outer cylinder. In the two locks, the second lock (60) is placed inside, more than the first lock (60). The second lock (60) includes the inner cylinder (21), which has an inner cylinder leading end (51) on its one end. The inner cylinder leading end (51) is inserted through the cylindrical hole (20) in the center of the outer cylinder (11).

The inner cylinder leading end (51) is combined with a rotating plate (19) to be fixed. The key inserting hole is formed at the center of the inner cylinder (21), and a spring recess (52) and a clamping recess (22), which are symmetrically formed to each other, are formed on both sides of vertical direction of the key insertion hole, respectively. At the time of arranging a plurality of springs (24) and a plurality of clamping members (23), they are assembled toward the center of the outer cylinder (11). The outer peripheral surface of the inner cylinder (21) is contacted to the supporting surfaces (49) of the supporting part (47) so that the center shaft of the inner cylinder is properly located. A plurality of clamping members (23) placed in the inner cylinder (21) are moved to the bottom surface of the first locking recess (27) due to the elasticity of the spring (24).

In the inner cylinder (21), an engaging recess (42), which is combined with the engaging pole (41) of the first lock (50), is formed on the opposite side of the inner cylinder leading end (51). If the engaging pole (41) having a cutaway portion (40) formed on one end of a cylinder (39) of the first lock (50) is inserted into the engaging recess (42), the engaging pole (41) is contacted and combined with the engaging recess (42) of the inner cylinder (21) to be integrally formed. Accordingly, the central rotating shafts of the first and the second locks (50, 60) are located on the same line, and the first lock (50) and the second lock (60) are integrally rotated.

The first lock (50) placed on the outer end of the outer cylinder (11) is a general cylindrical lock. The first lock (50) includes a rotating body (31), a fixing body (32), a plurality of alignment pins (33) and locking pins (34) corresponding thereto, and springs (35). Alignment pin recesses (36), which are placed on the rotating body (31), and the locking pin recesses (37), which are placed on the fixing body (32), of the first lock (50), are arranged on the same line to be combined with the clamping recesses (18) of the first cylindrical key (12). Then, the springs (35), the fixing body (32) and the rotating body (31) are placed, and the limitation ring (43) is placed in front of the rotating body (31) to be engaged toward the cylindrical hole (20) of the outer cylinder (11). The engaging pole (41) placed at the end of the cylinder (39) of the rotating body (31) is engaged with the engaging recess (42) of the inner cylinder (21). A fixing pin recess (53) is formed on the side surface of the fixing body (32) and corresponds to the fixing pin hole (54) of the outer cylinder (11). At the time of assembling, the fixing body (32) is fixed to the outer cylinder (11) by the fixing pin (55) which is inserted and fixed to the fixing pin recess (53) through the fixing pin hole (54). Due to this, if the first key (12) opens the first lock (50), only the rotating body (31) is rotated whereas the fixing body (32) is not rotated.

Figure 7:
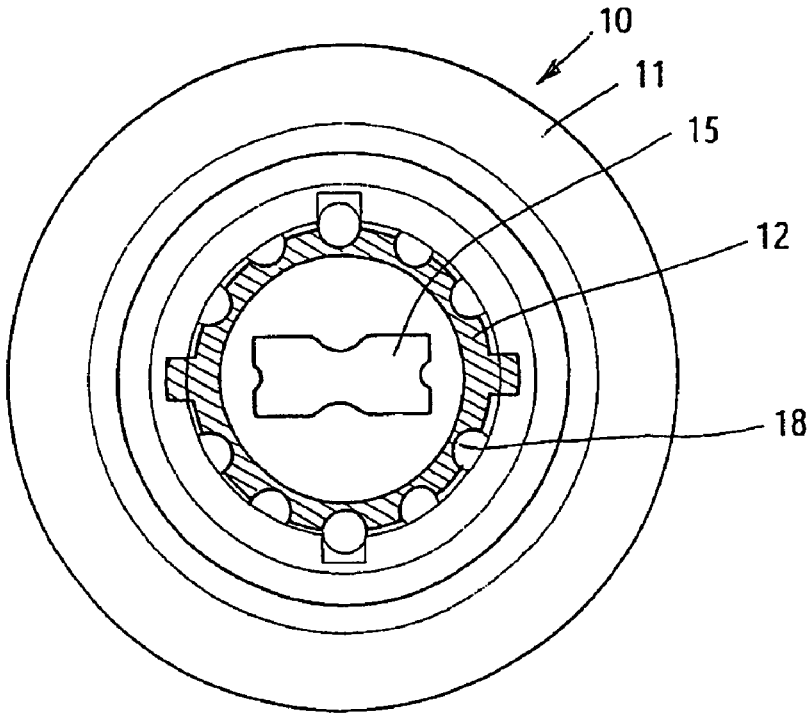
FIG. 7 is a floor plan view of a locking device according to the present invention showing the state in which the first key rotates the first lock to the right side by 90°.
Figure 8:
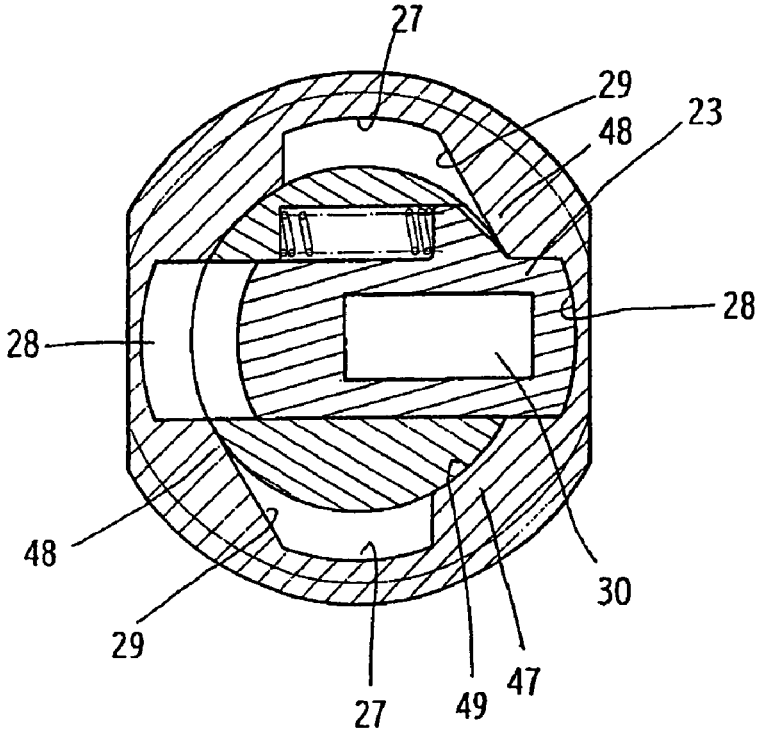
FIG. 8 is a cross-sectional view of a locking device according to the present invention showing the state in which the second lock is rotated to the right side by 90° in accordance with the first lock rotated to the right side by 90°.

As shown in FIGS. 1-6, a key inserting recess (14)is formed in the first lock (50) placed in front of the locking device (10). The key recesses (18) are formed in front of the cylinder; a predetermined form of handle (17) is formed on both sides of the back end; and a central key hole (16) is formed to which the second key (13) can penetrate at the center. A plurality of clamping members (23) arranged in the inner cylinder (21) of the second lock (60) respectively move to the first locking recess (27) by the elasticity of the spring (24). The first cylindrical key (12) is inserted by arranging the reference projection (56) in the key inserting recess (14) in front of the locking device (10). A plurality of key recesses (18) formed on the first cylindrical key (12) arrange the alignment pins (33) of the first lock (50) on the same plane, and the rotating body (31) is rotated by the rotation of the first key (12). At the time of rotating the first key (12), the engaging pole (41) at the end of the cylinder (39) of the rotating body (31) is engaged with the engaging recess (42) to rotate the inner cylinder (21), and thus the rotating plate (19) is rotated by 90°. Therefore, the locking device becomes opened (please refer to FIGS. 7 and 8).

As shown in FIGS. 2-4, the inner cylinder (21) of the second lock (60) placed inside of the outer cylinder (11) is arranged between the supporting parts (47) and the guiding parts (48) in the inner peripheral surface of the outer cylinder (11). The outer peripheral surface of the inner cylinder (21) is contacted and supported by the supporting surfaces (49) of the corresponding supporting parts (47) to have a fixed central shaft. The clamping members (23), which are respectively inserted into a plurality of clamping member recesses (22) of the inner cylinder (21), are pushed and inserted into the first locking recess (27) placed between the supporting part (47) and the guiding part (48).

As shown in FIG. 1, if the first key (12) is inserted into the first lock (50), the first lock (50) is open by the rotation of the first key (12). If the first key (12) is rotated to open the first lock (50) (please refer to FIGS. 2-4, 6 and 8), the first key (12) rotates the rotating body (31) and thus the inner cylinder (21) is rotated accordingly. The locations of a plurality of clamping members (23) placed in the inner cylinder (21) are moved according to the rotation angle, and the clamping members (23) are inserted inward along the guiding surface (29) of the guiding part (48). If the first key (12) is rotated by 90° (please refer to FIGS. 7 and 8), the inner cylinder (21) is rotated by 90° accordingly, and a plurality of clamping members (23) in the inner cylinder (21) are introduced by 90° (please refer to FIG. 4). Each clamping member (23) is moved outside by the elasticity of the spring (24) and is finally introduced and inserted into the second locking recess (28) between the supporting part (47) and the guiding part (48) (please refer to FIG. 8). The two side surfaces of the second locking recess (28) have the identical depth and limit the movement of a plurality of clamping members (23). Also, the inner cylinder (21) cannot be moved by the engaged clamping members (23). The first key (12), which opens the first lock (50) outside, cannot be pulled out from the key inserting recess by the limitation ring (43) (please refer to FIG. 7).

Figure 9:
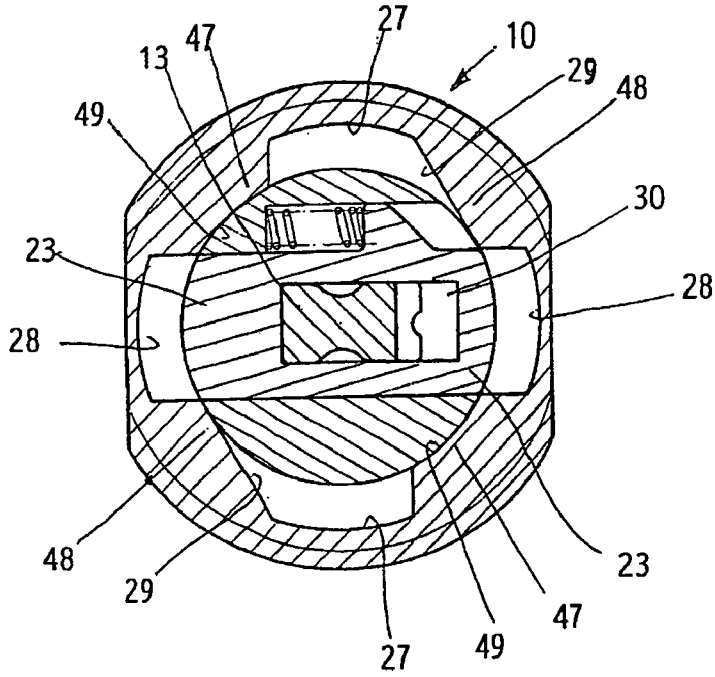
FIG. 9 is a cross-sectional view of a locking device according to the present invention showing the state in which the second key is inserted into the second lock.
Figure 10:
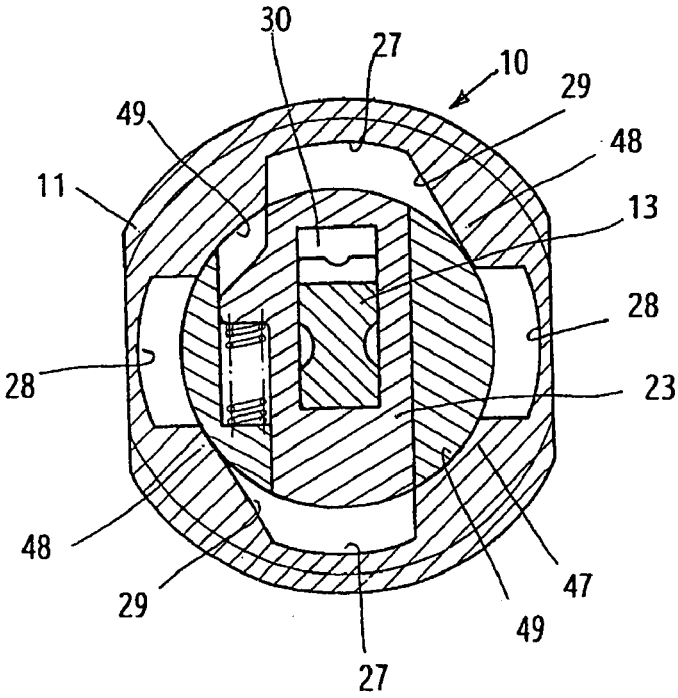
FIG. 10 is a cross-sectional view of a locking device according to the present invention showing the state in which the second lock is rotated to the left side by 90° and returned to the initial location in accordance with the second key rotated to the left side by 90°.

The second key (13), which is separatedly prepared for a manager, has a plurality of key recesses formed on a key plate to re-arrange and open the clamping members (23). The second key (13) inserted into the second lock (60) through the central key hole (16) of the first key (12) and the first lock (50). With regard to the center of the second lock (60), as shown in FIG. 9, the key recesses of the second key (13) move a plurality of clamping members (23) to an open location (the location moved inward facing the rotation shaft), and circular arc parts formed on the outer periphery of the clamping members (23) are introduced to the outer peripheral surface of the inner cylinder (21) having the same central shaft. By rotating the second key (13), the first and the second locks (50, 60) are simultaneously rotated and returned to the initial location (please refer to FIG. 10). Also, the reference projection (56) of the first key (12) corresponds to the key inserting recess (14) of the locking device (10), and thus the two keys (12, 13) can be simultaneously pulled out.

Meanwhile, the outer cylinder (11) of the locking device (10) can be placed in a fixed plate such as a door. The user is provided with the first key (12) to insert the first key (12) into the key inserting recess (14) of the locking device (10) and rotate the first lock (50) to open the door. The first key (12) simultaneously rotates the second lock (60), and the clamping members (23) of the second lock (60) are inserted into the second locking recess (28). Accordingly, the second lock (60) is maintained to be locked. The first key (12) is limited to be discharged from the locking device (10) by the limitation ring and is maintained to be inserted into the locking device accordingly. The manager inserts the second key (13) into the second lock (60) through the central key hole (16) of the first key (12) and the first lock (50) and then rotates it to make a plurality of clamping members (23) to be opened. At this time, since all of the outer end of the clamping members (23) are located on the outer peripheral line of the inner cylinder (21), the inner cylinder (21) can be freely rotated. If the second key (13) is rotated by 90°, the first lock (50) and the second lock (60) are rotated to the initial location. Accordingly, the locking device (10) returns to the initial state.

Although the invention has been shown and described with respect to the preferred embodiments, it will be understood by those having ordinary knowledge in the art that the present invention is not limited to the preferred embodiments, and that various changes and modifications may be made without departing from the spirit and scope of the invention as defined in the following claims.

What is claimed is:

1. A locking device comprising:

a first key capable of converting a first lock into an opening state or a locking state;

a second key insertable through a central key hole in the first key and capable of converting a second lock into an opening state or a locking state;

the first lock including a first key inserting recess, and which prevents discharge of the first key from the first inserting recess in case that the first key is inserted into the first inserting recess and converts the first lock from the locking state into the opening state absent the second key; and the second lock including a second key inserting recess, and converting the first lock from the opening state into the locking state in case that the second key is inserted into the second inserting recess and moves the second lock between its locking and opening states, wherein the first key can only be discharged from the first inserting recess when the second key is inserted into the second inserting recess and both keys may be removed.

2. The locking device according to claim 1, further comprising an outer cylinder having a hole in its center and mounting the first lock and the second lock in the hole.

3. The locking device according to claim 2, characterized in that the first key is cylindrical and has a central key hole to which the second key penetrates, and a reference projection is formed on one end of the first key.

4. The locking device according to claim 3, characterized in that the first key inserting recess is formed by placing a limitation ring on one end of the outer cylinder; and in case that the first key is inserted into the first key inserting recess and rotated to convert the first lock into the opening state, the first key is prevented from discharging by the reference projection clamped with the limitation ring.

5. The locking device according to claim 1, characterized in that the first lock and the second lock are cooperated by the combination of an engaging pole with an engaging recess.

6. The locking device according to claim 1, characterized in that the first lock comprises: a fixing body fixed integrally to an outer cylinder by a fixing pin; a rotating body having an engaging pole combined with an engaging recess of the second lock and being rotated together with the rotation of the first key inserted into the first key inserting recess; and a plurality of alignment pins, locking pins and springs placed between the fixing body and the rotating body, wherein the plurality of alignment pins are arranged in the same plane by key recesses of the first key.

7. The locking device according to claim 1, characterized in that the second lock comprises: an inner cylinder having an engaging recess combined with an engaging pole of the first lock; a plurality of clamping members and springs which are inserted into a plurality of clamping member recesses formed on one side of the inner cylinder; and a rotating plate combined with an inner cylinder leading end.

8. A locking device comprising:

an outer cylinder having a cylindrical hole in its center, a fixing hole in its one side, and supporting parts and guiding parts which are symmetric to each other in its side;

a first lock having a cylindrical shape, being inserted into the cylindrical hole of the outer cylinder, having an engaging pole combined to a second lock in one end thereof, and having a second key inserting recess in its center;

the second lock having an inner cylinder, being inserted into a supporting surface of a supporting part and a guiding part in the outer cylinder, having one end penetrating through an end of the outer cylinder, and having the other end connected to the first lock;

a first key having a key recess for opening the first lock, and having a central key hole to which a second key penetrates in its center; and the second key having a key recess for opening the second lock and having a length which passes through the first lock and reaches the second lock, wherein when the first key is inserted for opening the first lock, the first key is prevented from discharge from the first lock and the first key can only be discharged from the first lock when the second key is inserted into the second lock and both keys may be removed.

9. The locking device according to claim 8, characterized in that the first and second locks are combined by the engaging pole inserted into an engaging recess, and the first and second locks have the same rotating shaft.

10. The locking device according to claim 8, characterized in that the interior of the outer cylinder comprises: a supporting part contacting the outer peripheral surface of the inner cylinder to support the inner cylinder; first and second locking recesses which are separated at a predetermined angle with respect to the central shaft of the outer cylinder, and to which clamping members are inserted; and a guiding part placed between the first and second locking recesses to guide the rotation of the clamping members.

11. The locking device according to claim 10, characterized in that the guiding part comprises a guiding surface formed by a slope from the second locking recess to the bottom of the first locking recess.

12. The locking device according to claim 10, characterized in that the predetermined angle is 90°.

* * * * *

UNITED STATES PATENT AND TRADEMARK OFFICE

CERTIFICATE OF CORRECTION

PATENT NO. : 7,260,965 B2
APPLICATION NO. : 11/178817
DATED : August 28, 2007
INVENTOR(S) : Hung It is certified that error appears in the above-identified patent and that said Letters Patent is hereby corrected as shown below:

On the Title Page, Item (75)

Inventor Residence, replace "(CN)" with --(TW)--.

Signed and Sealed this

Fifteenth Day of April, 2008

JON W. DUDAS
*Director of the United States Patent and Trademark Office*